US009550616B2

(12) United States Patent
Hallak

(10) Patent No.: US 9,550,616 B2
(45) Date of Patent: Jan. 24, 2017

(54) TAMPER EVIDENT CONTAINER

(75) Inventor: Bassam Hallak, Newport (AU)

(73) Assignee: Avery Dennison Corporation, Glendale, CA (US)

( * ) Notice: Subject to any disclaimer, the term of this patent is extended or adjusted under 35 U.S.C. 154(b) by 0 days.

(21) Appl. No.: 13/638,003

(22) PCT Filed: May 24, 2011

(86) PCT No.: PCT/US2011/037637

§ 371 (c)(1),
(2), (4) Date: Sep. 28, 2012

(87) PCT Pub. No.: WO2011/149865

PCT Pub. Date: Dec. 1, 2011

(65) Prior Publication Data

US 2013/0056470 A1 Mar. 7, 2013

Related U.S. Application Data

(60) Provisional application No. 61/347,971, filed on May 25, 2010.

(51) Int. Cl.
*B65D 75/58* (2006.01)
*B65D 75/32* (2006.01)

(52) U.S. Cl.
CPC ..... *B65D 75/5855* (2013.01); *B65D 75/326* (2013.01); *B65D 75/5805* (2013.01);
(Continued)

(58) Field of Classification Search
CPC ..... B65D 2575/362; B65D 75/32
(Continued)

(56) References Cited

U.S. PATENT DOCUMENTS 3,329,331 A 7/1967 Morgan
3,426,936 A * 2/1969 Palmer ..... 220/270
(Continued)

FOREIGN PATENT DOCUMENTS

DE 102006002965 8/2007
EP 0447636 9/1991
(Continued)

OTHER PUBLICATIONS

European Patent Office Communication Pursuant to Article 94(3) EPC issued in corresponding EP Application No. 10 712 843.1 dated Oct. 29, 2012.
(Continued)

*Primary Examiner* — Anthony Stashick
*Assistant Examiner* — Mollie Impink
(74) *Attorney, Agent, or Firm* — Avery Dennison Corporation

(57) ABSTRACT

A container having provisions that indicate tampering or previous attempts in opening the container is described. The container includes a peel tab for opening the container to thereby gain access to the container interior and contents therein. The container further includes pull tab provisions which must be at least partially separated from a container substrate, in order to gain access to the peel tab. Separation of the pull tab provisions provides indication of tampering or prior opening attempts. Related methods of providing such indication are also described.

20 Claims, 5 Drawing Sheets

(52) U.S. Cl.
CPC .. *B65D 75/5844* (2013.01); *B65D 2101/0023* (2013.01); *B65D 2101/0084* (2013.01); *B65D 2575/362* (2013.01); *B65D 2575/368* (2013.01)

(58) Field of Classification Search
USPC ..... 206/461, 534.1, 534.2, 247, 807, 534, 206/539; 220/270, DIG. 34, 266; 1/461, 1/534.1, 534.2, 247, 807, 534, 539
See application file for complete search history.

(56) References Cited

U.S. PATENT DOCUMENTS

| | | | | |
|---|---|---|---|---|
| 3,454,210 | A * | 7/1969 | Spiegel et al. | 229/123.1 |
| 3,498,448 | A * | 3/1970 | Kuster | 206/440 |
| 3,941,248 | A * | 3/1976 | Moser et al. | 206/531 |
| 4,260,061 | A | 4/1981 | Jacobs | |
| 4,468,811 | A * | 8/1984 | Shaw | A61B 19/026 206/439 |
| 4,810,541 | A | 3/1989 | Newman et al. | |
| 5,046,618 | A * | 9/1991 | Wood | 206/532 |
| 5,064,664 | A * | 11/1991 | Hustad et al. | 206/459.1 |
| 5,089,320 | A | 2/1992 | Straus et al. | |
| 5,184,771 | A * | 2/1993 | Jud et al. | 229/87.05 |
| 5,217,307 | A * | 6/1993 | McClintock | 383/81 |
| 5,325,968 | A * | 7/1994 | Sowden | 206/532 |
| 5,382,472 | A | 1/1995 | Yanidis et al. | |
| 5,623,011 | A | 4/1997 | Bernard | |
| 5,728,469 | A | 3/1998 | Mann et al. | |
| 5,758,774 | A * | 6/1998 | Leblong | 206/531 |
| 5,830,571 | A | 11/1998 | Mann et al. | |
| 5,857,565 | A * | 1/1999 | Baker et al. | 206/232 |
| 5,882,749 | A | 3/1999 | Jones et al. | |
| 5,882,789 | A | 3/1999 | Jones et al. | |
| 5,919,547 | A | 7/1999 | Kocher et al. | |
| 5,954,431 | A * | 9/1999 | Fabel | 383/5 |
| 6,056,141 | A | 5/2000 | Navarini et al. | |
| 6,147,165 | A | 11/2000 | Lee et al. | |
| 6,302,290 | B1 | 10/2001 | Engelaere | |
| 6,486,267 | B1 | 11/2002 | Bilodeau | |
| 6,630,237 | B2 | 10/2003 | Rivett et al. | |
| 6,737,130 | B2 | 5/2004 | Ferri | |
| 6,752,431 | B1 | 6/2004 | Matthews et al. | |
| 6,777,050 | B1 | 8/2004 | Engelaere | |
| 6,893,672 | B2 | 5/2005 | Ingraham | |
| 6,902,817 | B2 | 6/2005 | Bowen et al. | |
| 7,165,888 | B2 | 1/2007 | Rodick | |
| 7,322,473 | B2 | 1/2008 | Fux | |
| 7,371,008 | B2 | 5/2008 | Bonenfant | |
| 7,422,782 | B2 | 9/2008 | Haedt et al. | |
| 7,681,732 | B2 * | 3/2010 | Moehlenbrock et al. | 206/459.1 |
| 2004/0013827 | A1 | 1/2004 | Zuser et al. | |
| 2004/0033379 | A1 | 2/2004 | Grunlan et al. | |
| 2004/0180118 | A1 | 9/2004 | Renger et al. | |
| 2004/0191459 | A1 | 9/2004 | Driesten | |
| 2005/0031233 | A1 | 2/2005 | Varanese et al. | |
| 2005/0074549 | A1 | 4/2005 | Su et al. | |
| 2005/0276525 | A1 | 12/2005 | Hebert et al. | |
| 2006/0172131 | A1 | 8/2006 | Haedt et al. | |
| 2007/0082161 | A1 | 4/2007 | Cruz et al. | |
| 2007/0116910 | A1 | 5/2007 | Polykarpov et al. | |
| 2007/0134459 | A1 | 6/2007 | Hubert et al. | |
| 2007/0275133 | A1 | 11/2007 | Sierra-Gomez et al. | |
| 2008/0105582 | A1 * | 5/2008 | Ludwig et al. | 206/438 |
| 2008/0118688 | A1 | 5/2008 | Kinigakis et al. | |
| 2008/0156861 | A1 | 7/2008 | Sierra-Gomez et al. | |
| 2008/0190809 | A1 * | 8/2008 | Simon et al. | 206/532 |
| 2012/0067896 | A1 | 3/2012 | Daffner et al. | |
| 2012/0177307 | A1 | 7/2012 | Duan et al. | |
| 2013/0020328 | A1 | 1/2013 | Duan et al. | |

FOREIGN PATENT DOCUMENTS

| | | |
|---|---|---|
| EP | 0608801 | 8/1994 |
| EP | 1016598 | 7/2000 |
| EP | 1193294 | 4/2002 |
| EP | 1449789 | 8/2004 |
| EP | 1582341 | 10/2005 |
| EP | 1685954 | 8/2006 |
| EP | 1775122 | 4/2007 |
| GB | 2319746 | 6/1998 |
| WO | WO94/29104 | 12/1994 |
| WO | WO96/03329 | 2/1996 |
| WO | WO02/066341 | 8/2002 |
| WO | WO2004/074130 | 9/2004 |
| WO | WO2005/014406 | 2/2005 |
| WO | WO2005/123535 | 12/2005 |
| WO | WO2008/086388 | 7/2008 |
| WO | WO2008/115693 | 9/2008 |
| WO | WO2009/089009 | 7/2009 |

OTHER PUBLICATIONS

Response to European Patent Office Communication Pursuant to Rules 161(1) and 162 EPC dated Nov. 8, 2011, as well as to the Written Opinion of the ISA dated Oct. 4, 2011 as filed in corresponding EP Application No. 10 712 843.1 dated May 11, 2012.
Response to European Patent Office Communication Pursuant to Rules 161(1) and 162 EPC dated Apr. 26, 2012 in corresponding EP Application No. 10 759 767.6 dated Nov. 7, 2012.
International Search Report and Written Opinion issued in corresponding IA No. PCT/US2010/048558 dated Nov. 16, 2010.
International Preliminary Report on Patentability issued in corresponding IA No. PCT/US2010/029352 dated Oct. 13, 2011.
International Search Report and Written Opinion issued in corresponding IA No. PCT/US2011/037637 dated Sep. 21, 2011.
International Preliminary Report on Patentability issued in corresponding IA No. PCT/US2011/030255 dated Oct. 11, 2012.
International Search Report and Written Opinion issued in corresponding IA No. PCT/US2011/030255 dated Jun. 30, 2011.
International Search Report and Written Opinion issued in corresponding IA No. PCT/US2011/030246 dated Aug. 11, 2011.
International Search Report and Written Opinion issued in corresponding IA No. PCT/US2010/029352 dated May 27, 2010.

* cited by examiner

TAMPER EVIDENT CONTAINER

CROSS-REFERENCE TO RELATED APPLICATION

The present application is a 371 of International Application No. PCT/US2011/037637, which was published in English on Dec. 1, 2011, which claims the benefit of U.S. Provisional Application No. 61/347,971 filed May 25, 2010, which is incorporated herein by reference in its entirety.

FIELD OF THE INVENTION

The present invention relates to containers with provisions that indicate tampering and/or previous attempts to open the container. The invention also relates to methods of indicating container tampering.

BACKGROUND OF THE INVENTION

Containers or packaging systems that provide indication of tampering are well known in the art. Typically, such provisions are in the form of perforation patterns formed in overlying layers in the container. Upon separation of the layers from one another in order to open the container, it is difficult if not essentially impossible to re-align the patterns in their original configuration prior to opening. However, in certain situations, perforation patterns can be sufficiently re-aligned such that without close inspection, a pattern may appear to have never undergone an initial separation or container opening. Accordingly, a need exists for an improved container tampering indicator, and particularly which more dramatically indicates a previous opening, opening attempt, and/or tampering.

Although a variety of other tamper indicating provisions are known in the art, each suffers from one or more drawbacks. A common disadvantage to many known tamper indication systems is the cost of providing and/or incorporating such in a container or package. Often intricate and complex structures or configurations must be formed or incorporated in the container. These increase container cost and/or manufacturing complexity. Therefore, a need exists in the art for a tamper evident container which provides clear indication of tampering or previous attempts at opening, and yet which is relatively inexpensive to produce and incorporate in a container or package.

SUMMARY OF THE INVENTION

The difficulties and drawbacks associated with previous-type systems are addressed in the present tamper evident containers, container assemblies, and methods.

In one aspect, the present invention provides a tamper evident container comprising a substrate defining an outer face and an oppositely directed inner face. The container also comprises a cover layer disposed on the substrate, the cover layer defining an outer face and an oppositely directed inner face. The cover layer and the substrate are sealed to one another in at least one sealing region to thereby define an initially sealed interior region. The cover layer and the substrate define a peripheral edge extending about at least a portion of an outer perimeter of the container. The cover layer defines at least one line of weakened material extending between a first region of the edge to a second region of the edge and proximate the interior region. The at least one sealing region extends between the at least one line of weakened material and the interior region. The cover layer and the substrate further define a sealing-free region co-extensive with the at least one line of weakened material.

In another aspect, the present invention provides a tamper evident container comprising a substrate and a cover layer sealingly joined to the substrate. The substrate and the cover layer define an interior region therebetween. The cover layer includes at least one line of weakened material which defines a tear off tab. The cover layer also defines a peel tab adjacent to the tear off tab and which can only be accessed after separation of at least a portion of the tear off tab from the substrate, the separation providing evidence of container tampering.

In yet another aspect, the present invention provides a method of providing indication of container opening attempts having occurred. The method comprises providing a container including a substrate and a cover layer sealingly joined thereto. The substrate and the cover layer defining an interior region therebetween. The cover layer includes at least one line of weakened material which defines a tear off tab. The cover layer also defines a peel tab adjacent to the tear off tab and which can only be accessed after separation of at least a portion of the tear off tab from the substrate. The method also comprises separating at least a portion of the tear off tab from the substrate whereby at least a portion of the line of weakened material is severed, thereby providing indication of occurrence of an attempt to open the container.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Generally, the present invention provides various containers having covers, substrates, and provisions for indicating tampering, previous opening, or attempts thereof. The invention also provides methods of indicating previous opening, opening attempts and/or tampering of containers by use of the particular provisions and strategies described herein.

The term "container" as used herein refers to an enclosure, housing, or package that provides an interior hollow region within which for example food or other items can be stored. The interior of the container is typically accessed by removing, partially removing, or at least separating a cover layer from a corresponding substrate or layer. The container can be formed, preferably from a relatively rigid shape-retaining material such that the container defines a recessed open interior region that is accessible by separation of a cover layer therefrom. The preferred forms of the container in accordance with the present invention exhibit one or more relatively rigid walls formed and/or arranged about an opening that provide unobstructed access to the interior of the container.

Preferably extending about the periphery of the container opening, is a lip or other structural member that defines a region for contacting and sealing with the cover. Preferably, a layer of a heat sealing material is disposed along a face or at least a region of the face of the lip for subsequent contact with the heat sealing layer of the cover laminate during thermal bonding between the cover and container.

Although the preferred form of the container is a rigid wall receptacle having the previously described lip, the present invention includes the use of flexible wall enclosures such as a bag, pouch, or packet.

The term "cover" as used herein refers to any single layer or multilayer laminate that is used to overlay one or more interior regions defined in a corresponding container, substrate and which can be effectively secured to the container to thereby enclose and seal the interior of the container.

In accordance with the invention, containers are provided with provisions that indicate a previous opening, opening attempt, and/or tampering of the container. In order to access an interior hollow region of the container and the contents therein, one or more cover layers must be separated from an underlying container substrate. Such separation is performed by initial pulling and/or engagement of a pull tab, generally formed as part of the cover layer. In order to access the pull tab, a separate member referred to herein as a tear off tab must be at least partially torn or separated along one or more lines of weakened material defined in the cover layer. Removal or at least partial tearing or separation of the tear off tab from the remainder of the cover layer provides indication of opening, attempt at opening, and/or tampering of the container.

Figure 1:
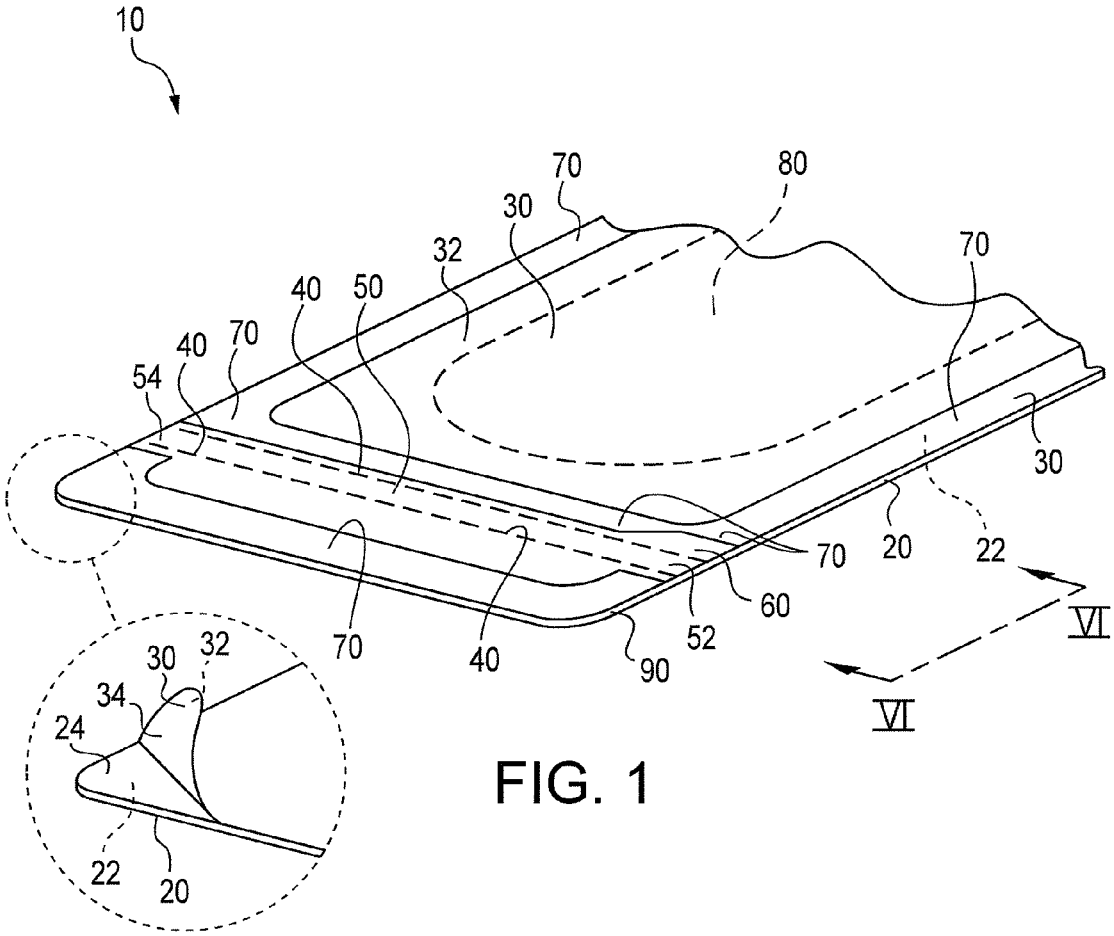
FIG. 1 is a schematic view of a preferred embodiment container in accordance with the present invention.

FIG. 1 illustrates a preferred embodiment tamper evident container 10 in accordance with the present invention. The container 10 comprises a substrate 20 defining an outer face 22 and an oppositely directed inner face 24. The container 10 also comprises a cover layer 30 defining an outer face 32 and an oppositely directed inner face 34. The cover layer 30 is positioned relative to the substrate 20 such that the inner face 34 of the cover layer is directed toward the inner face 24 of the substrate. Preferably, the cover layer inner face 34 contacts the substrate inner face 24. This configuration is depicted in the enlarged view in FIG. 1 of a corner region of the container 10. However, it will be appreciated that the present invention includes the use of one or more layers in addition to the cover layer, as described in greater detail herein.

Referring further to FIG. 1, the substrate 20 and the cover layer 30 are joined to one another in such fashion so as to define an interior region 80 of the container. The interior region 80 may be in a variety of different shapes, sizes, and configurations depending upon the joining of the cover layer and the substrate, and the shape or configuration of each of these components. For example, a relatively large void or cavity can be provided for the interior region 80 by use of a substrate 20 that provides a preferred, rigid wall, recessed cavity which can be enclosed by the cover layer 30. Alternatively, the interior region 80 can be in the form of a "pocket" resulting from spacing between the substrate 20 and the cover layer 30. The particular configuration of the interior region 80 will primarily depend upon the end use requirements of the container 10.

FIG. 1 illustrates a preferred configuration for selectively joining the substrate 20 and the cover layer 30 together. One or more regions of sealing 70 (or "sealed regions 70" as also referred to herein) are provided between the substrate 20 and cover layer 30 that extend around the interior region 80. Generally, the sealed regions 70 extend between the interior region 80 and a container edge 90 generally extending about the outer perimeter of the container 10. Sealing between the adjoining components, e.g. the substrate 20 and the cover layer 30, within the sealed regions 70 can be provided in a variety of different manners. For example, a layer of a releasable and resealable adhesive can be used within the sealed regions 70 to effect sealing. Alternatively or in addition, heat sealing techniques may be used to provide sealing between the adjoining components. For the preferred various tamper evident containers described herein, heat sealing in conjunction with an effective amount of a resealable adhesive is generally preferred.

With further reference to FIG. 1, the container 10 provides at least one region or line 40 along the cover layer 30 of weakened material. The line 40 of weakened material may be in the form of a series of perforations extending partially or entirely through the thickness of the cover layer 30. Alternatively or in addition, the line 40 of weakened material may be in the form of scores or other deformations to the cover layer 30. It is also contemplated that other physical or chemical means could be used to form a region or line 40 of weakened material along a portion of the cover layer 30. The line 40 of weakened material preferably extends across the container 10, such as from a first region of the edge 90 to a second region of the edge 90. Preferably, the container 10 includes two or more lines 40 of weakened material such as shown in FIG. 1. The two lines 40 of weakened material are preferably oriented generally parallel to one another and spaced apart from one another to thereby define a tear off or pull tab 50 between the two lines 40. The tear off tab 50 preferably extends between the pair of lines 40 of weakened material and also extends from a first region of the edge 90 to a second region of the edge 90. The tear off tab 50 includes a pull end 52, adjacent to a region of the edge 90, and a second, opposite end referred to herein as a secondary end 54.

The container 10 also includes a peel tab 60 at a location adjacent to the pull end 52 of the tear off tab 50 and also alongside the edge 90 of the container 10. Preferably, the peel tab 60 is immediately adjacent and extends alongside a portion of the tear off tab 50 and specifically, the pull end 52 of the tear off tab 50.

It will be understood that both the tear off tab 50 and the peel tab 60 constitute portions of the cover layer 30. Both the tear off tab 50 and the peel tab 60 are free of sealing to the substrate 20. Thus, both the tear off tab 50 and the peel tab 60 are free of any sealed regions 70. This feature is exemplified in FIG. 1 in which the sealed region 70 does not extend within either of the regions of the cover layer 30 constituting the tear off tab 50 or the peel tab 60. In a particularly preferred embodiment, a sealing free region, i.e. a region of the container 10 which is free of any sealed regions 70, is sized, shaped, and configured to be co-extensive with the one or more, e.g. two, lines 40 of weakened material that form the tear off tab 50. And, the sealing free region(s) associated with the peel tab 60 is also preferably sized, shaped, and configured to be co-extensive with the peel tab 60.

Figure 2:
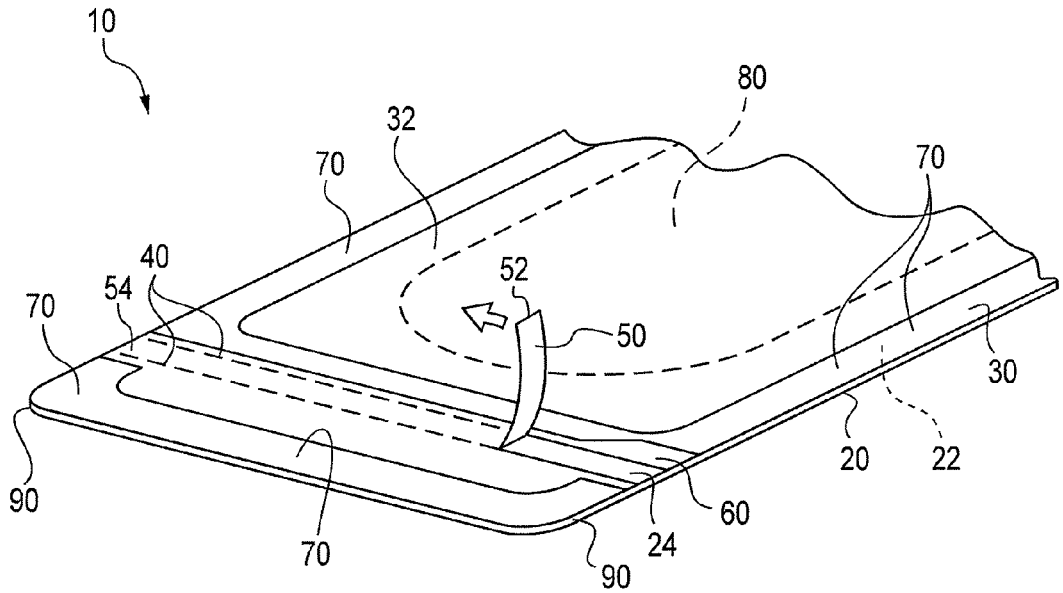
FIG. 2 is an illustration of a first step in initially opening the container of FIG. 1 by engaging and pulling a tear off tab.

FIGS. 2 to 5 schematically depict a series of operations to initially "open" the container 10 to gain access to the interior region 80 defined between the cover layer 30 and the substrate 20. In FIG. 2, an end or portion of the tear off tab 50 is separated from the substrate 20. Preferably, the pull end 52 of the tear off tab 50 is engaged or grasped by a user and pulled from the substrate 20 as shown. Since the region between the tear off tab 50 and the substrate 20 is free of sealing, the tab 50 readily separates from the substrate 20. As the user continues to urge the pull end 52 of the tab 50 away from the substrate 20, the region of the cover layer 30 constituting the tear off tab 50 severs, tears, or otherwise separates from adjoining regions of the cover layer 30 along the lines 40 of weakened material.

Figure 3:
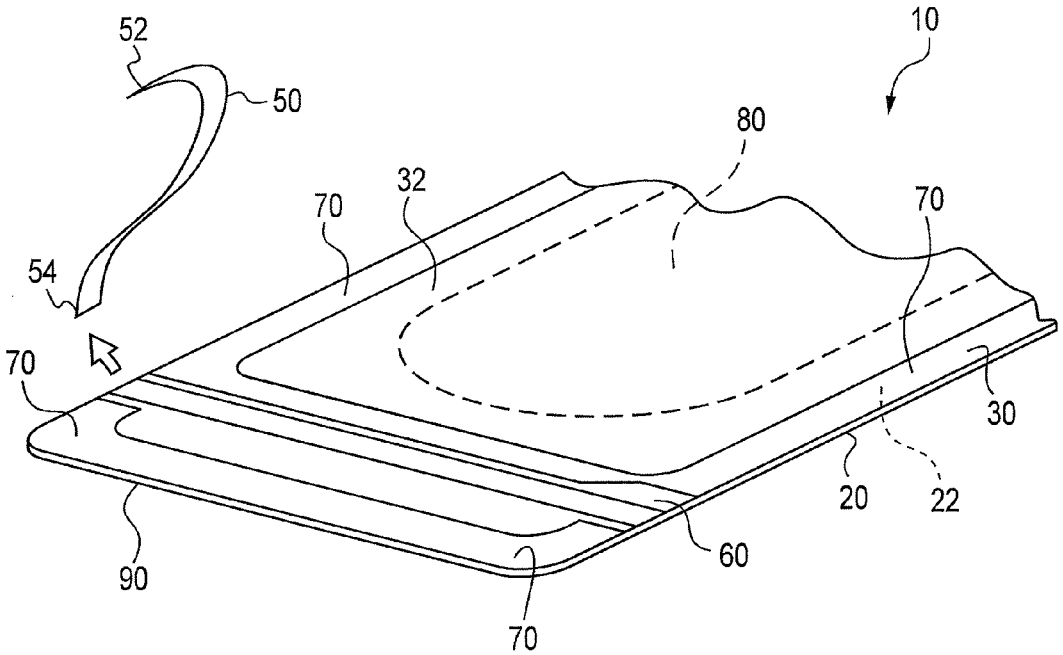
FIG. 3 is an illustration of a subsequent step in initially opening the container of FIG. 1 by continuing to pull and separate the tear off tab from a remainder of the container.

Pulling of the tear off tab 50 is continued as depicted in FIG. 3, preferably until the tab 50 is completely separated from the container 10. Although the tear off tab 50 is preferably completely separated from the container 10, the invention includes embodiments in which the tab 50 remains with the container 10.

Figure 4:
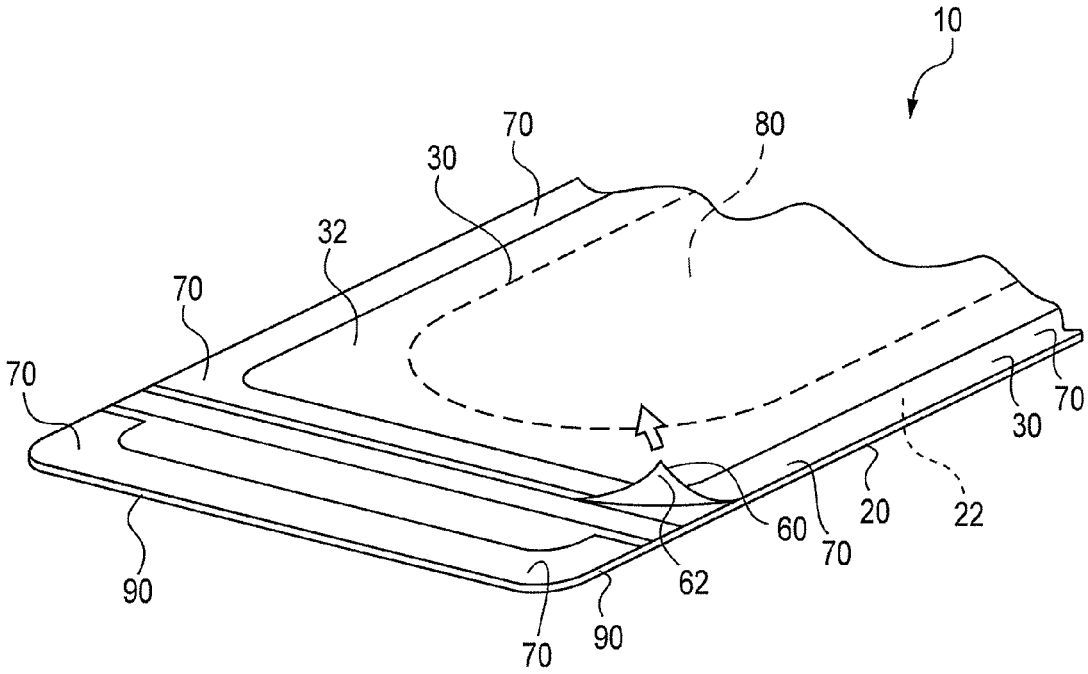
FIG. 4 is an illustration of a subsequent step after the operation depicted in FIG. 3, in which a peel tab is pulled.

Removal of the tear off tab 50 along the vicinity of the peel tab 60 and preferably entirely from the container 10, enables access to the peel tab 60. Thus, as shown in FIG. 4, after removal of the tear off tab 50, the peel tab 60 can then be engaged or grasped by a user and pulled away from the substrate 20. Generally, the peel tab 60 is separated from the substrate 20 by a user grasping a peripheral edge 62 of the peel tab 60 and pulling the portion of the cover layer 30, e.g. the peel tab 60, away from the substrate 20. Initially, the peel tab 60 can be readily separated from the substrate 20 since the peel tab 60 is free of any sealing to the substrate. However, upon pulling the peel tab 60 away from the substrate 20, the retreating interface between these components reaches a sealed region 70. Thus, it is contemplated that greater amounts of force may be required to separate the cover layer 30 from the substrate 20 within the sealed region 70. It will be understood that this operation at least partially separates the cover layer 30 from the substrate 20.

Figure 5:
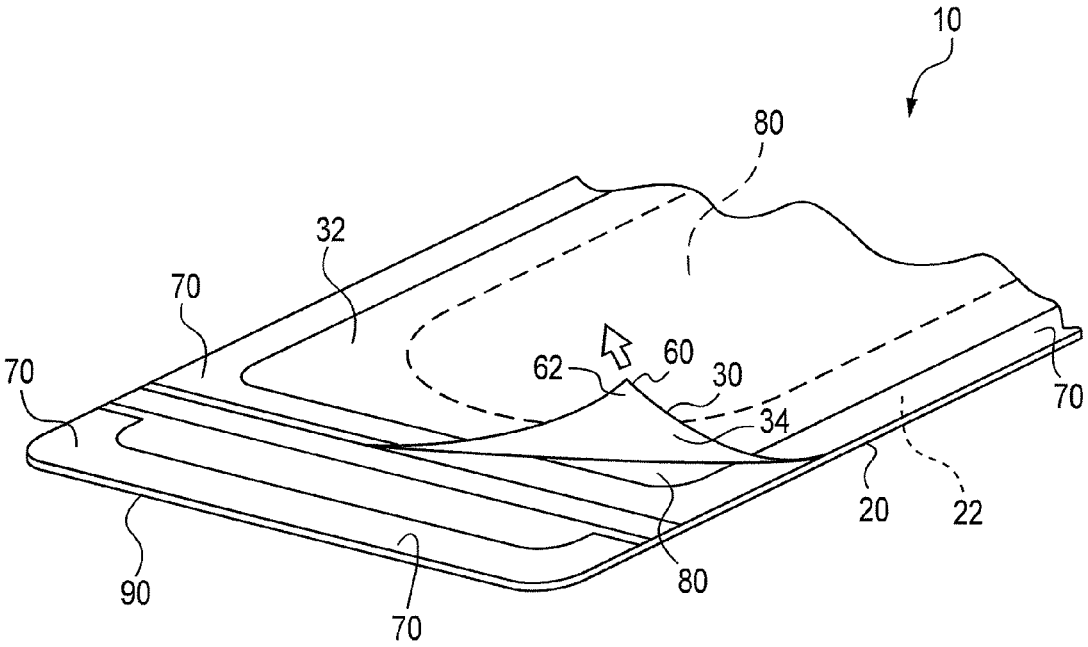
FIG. 5 is an illustration of the package depicted in FIG. 4 after further pulling of the peel tab.

Continued pulling of the peel tab 60 and associated cover layer 30 results in further separation of the cover layer 30 from the substrate 20 to thereby provide access to the interior region 80 of the container 10, as shown in FIG. 5.

The container 10 includes an effective amount of a releasable yet resealable adhesive and preferably a pressure sensitive adhesive (PSA) disposed within the sealed region 70 extending about the interior region 80 of the container 10. This enables the cover layer 30 to be readily rejoined with the substrate 20 after an initial opening operation.

As will be understood, the container 10 is initially opened by use of the peel tab 60. However, the peel tab 60 can only be accessed by removal, or at least partial removal, of the tear off tab 50. Removal of the tear off tab 50 from the container 10 is readily apparent and thereby provides visual and tactile indication that the container 10 has been previously opened. As will be appreciated, this configuration provides a simple, convenient, and inexpensive strategy for evidence of container tampering.

The present invention tamper evident container can also include additional provisions for signaling a previous container opening. For example, providing particular colors, color combinations, indicia, and/or marking on one or more layers may provide even greater indication to a user that the container has been previously opened or attempts at opening the container have been undertaken. Specifically, referring to FIG. 2, a bright coloring could be provided on the inner face 24 of the substrate 20 at least within the region of the tear off tab 50. For an opaque or colored cover layer 30, upon removal of the tear off tab 50, the brightly colored region is then rendered visible. A wide assortment of other strategies and techniques could be used to further promote or enhance indication of a previous opening operation or attempt having occurred.

Figure 6:
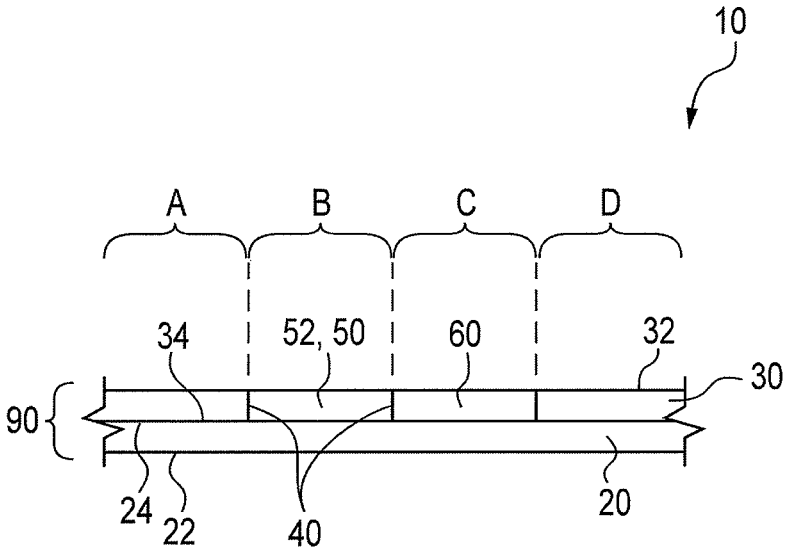
FIG. 6 is a schematic side elevational view of an edge region of the container shown in FIG. 1, taken from line VI-VI.

FIG. 6 is a side elevational schematic view of the edge 90 of the container 10, illustrating in greater detail the pull end 52 of the tear off tab 50 and the peel tab 60. Both of these components are provided within the cover layer 30 and disposed on the substrate 20. The tear off tab 50 and the pull end 52 are defined between the lines 40 of weakened material. As previously explained, regions B and C are free of sealing, and in particular are free of heat sealing. Sealed regions 70 may and preferably exist within regions A and D.

Figure 7:
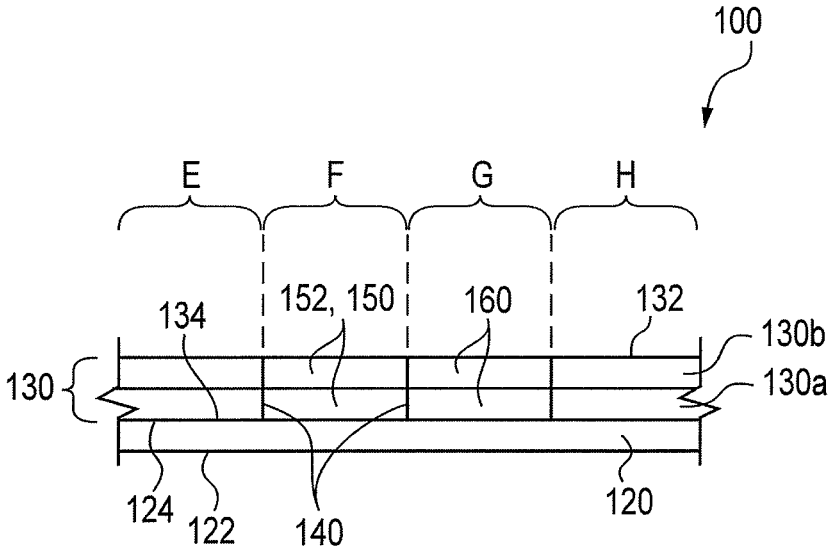
FIG. 7 is a schematic side elevational view of an edge region of another preferred embodiment container in accordance with the present invention.

The preferred embodiment containers of the present invention may also comprise one or more additional layers in conjunction with the previously described cover layer. Referring to FIG. 7, a schematic side elevational view of another preferred embodiment container 100 is illustrated. In this version of the invention, a multilayer laminate 130 including a first layer **130*a* and a second layer 130*b* is provided in conjunction with a substrate 120 having an inner face 124 and an outer face 122. The laminate has a cover layer inner face 134 and a cover layer outer face 132. Two spaced apart lines 140 of weakened material are provided within the laminate 130 thereby defining a tear off tab 150 having a pull end 152. A peel tab 160 is provided alongside the pull end 152 of the tear off tab 150. As previously explained, the regions of the tear off tab 150 and the peel tab 160 are free of heat sealing, i.e. regions F and G. Heat sealing may be provided within regions E and H of the container 100**.

In addition, the present invention containers may additionally include one or more overhanging or over-extending material sections associated with the pull off tab and/or the peel tab to promote and facilitate grasping by a user. For example, referring to FIG. 1, the cover layer 30 can be formed to extend laterally outward beyond the edge 90 of the container within the region of the pull end 52 of the tear off tab 50. Such overhanging section of material can be readily grasped by a user to initiate separation of and ultimately removal of the tear off tab 50 from the substrate 20.

In addition to various tamper evident containers, the present invention also provides methods of providing indication of container opening attempts having occurred. Preferably, these methods involve providing a container as described herein which includes provisions for a tear off tab formed by one or more lines of weakened material and a peel tab and which are configured such that the peel tab can only be accessed after separation of at least a portion of the tear off tab from an underlying container substrate. Upon separating at least a portion of the tear off tab from the substrate, at least a portion of the line of weakened material is severed thereby providing indication of occurrence of an attempt to open the container.

The container can include any or all of the previously described features such as but not limited to the provision of a pair of spaced apart parallel lines of weakened material to thereby define a tear off tab therebetween, a colored region proximate the tear off tab which is visible upon separating the tear off tab from the substrate, forming the line of weakened material by perforating or scoring the cover layer, and the use of a multilayer laminate for the cover layer.

As previously noted, the present invention includes the use of cover layers that are in the form of a single layer or a multilayer laminate.

Figure 8:
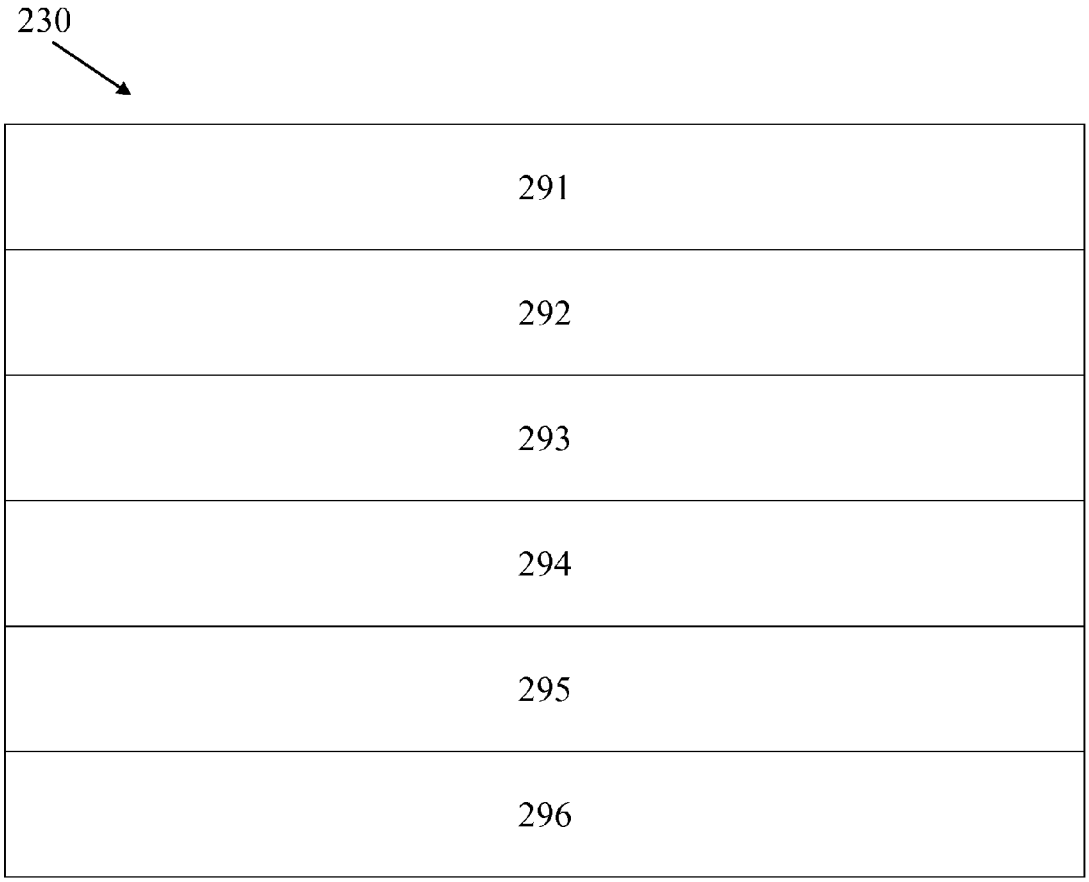
FIG. 8 is a schematic side view of an embodiment of a portion of a multilayer cover laminate in accordance with the present disclosure.

Referring to FIG. 8, preferably, the cover laminate 230 comprises (without regard to any order of the layers) an outer support film or layer 291, a barrier material layer 292, an adhesive layer 293, an optional release layer 294 (which may be pressure sensitive), an inner support film or layer 295, and a heat sealing layer 296. An optional printing layer may also be used. Each of these layers within the preferred multilayer cover laminate is described as follows.

Cover Outer Support

The preferred multilayer cover laminate includes an outer support film to provide support for the cover and particularly for an outermost portion of the cover resulting from initial opening of the container and thus at least partial separation of the cover from the underlying substrate. The outer support can be formed from a wide array of materials such as polyethylene terephthalate film, polyolefin film materials or paper, cardboard, or other paper-based materials. Representative materials for the outer support include, but are not limited to, polyethylene terephthalate (PET), polyethylene (PE), polypropylene (PP), both oriented and nonoriented, and copolymers thereof. Another example of a potentially suitable film for the cover outer support is a layer of polyvinyl chloride (PVC) and copolymers thereof. Additional materials include, but are not limited to, polyvinyl chloride (PVC), and ortho-phthalaldehyde (OPA). For many applications, PET is preferred.

The cover outer support can be utilized at various thicknesses in the cover laminate. The outer support can have a typical thickness of from about 12 to about 60 microns, and a preferred thickness of from about 12 to about 25 microns.

Since the outer face of the outer support will likely constitute the outermost surface of the cover, it is desirable that the material selected for the outer support, at least along this outwardly directed face, exhibit attractive printability characteristics.

Printability is typically defined by the sharpness and brightness of the image and by ink anchorage. The sharpness is closely related to the surface tension of the print surface. The ink anchorage is often tested by a tape test (Finat test: FTM21). In general, PVC is printable with a variety of inks intended to be used with PVC. In most occasions the inks are water-based (especially in the US) or designed for UV drying (especially in Europe). In general, all polyolefin films can be printed with UV inks after on-press corona treatment, PE being better than PP mainly on ink adhesion. For waterbased inks an additional primer or topcoat is preferred to achieve good ink anchorage.

As explained herein, the cover laminate may include an optional printing layer disposed on an outer face of the cover or below the outer support film or layer on an inner surface of the outer support.

Cover Barrier Material Layer

According to one embodiment, the preferred multilayer cover laminate includes a barrier material layer to promote the sealing characteristics of the cover and resulting sealed cover and container assembly. Typically, it is desirable for the barrier material to exhibit resistance to oxygen transport or diffusion through the material. This is particularly desirable for sealing applications involving certain foods. A wide range of barrier materials can be used for the barrier material layer. The selection of the barrier material(s) is largely dictated by the degree of sealing required and hence, by the contents for which the sealing assembly is to house. Representative materials for use in the barrier material layer include, but are not limited to, polyvinyl alcohol (PVOH) and ethylene vinyl alcohol (EVOH) polymers. A well known and preferred barrier material is polyvinylidene chloride (PVDC). It is also contemplated that nylon and various nylon-based polymers known in the art could be used. It is further contemplated that combinations of these materials could be used, and in particular, multiple films of these materials could be utilized. An excellent discussion of barrier materials and their characteristics is provided in US Patent Application Publication 2004/0033379, owned by the assignee of the present application. Preferred materials for the barrier material include PVDC, PVOH, EVOH, and combinations thereof.

The barrier material is typically utilized at relatively small thicknesses in the preferred cover laminate. For example, the barrier material layer thickness is preferably from about 1 to about 5 microns, and preferably from about 1 to about 3 microns in thickness.

As noted, preferably the barrier material exhibits relatively low oxygen permeability. Preferred maximum oxygen permeability is approximately 50 $cc/m^2/24$ hours. Most preferably, the oxygen permeability is 0.5 to 7 $cc/m^2/24$ hours.

For certain applications, it is contemplated that the cover laminate of the present invention can be free of a barrier layer. However, the preferred embodiment includes a barrier layer.

Cover Adhesive Layer

The preferred multilayer cover laminate includes an adhesive layer. In one embodiment, the adhesive layer is a pressure sensitive adhesive layer and the adhesive provides a tacky surface allowing a bond to another contacting surface. Preferably, the properties of the adhesive are such that the bond also provides a seal to prevent or at least significantly prevent the flow of air or other agents across the region of the adhesive. The adhesive layer may be a single adhesive layer or may be a multilayer adhesive.

A wide range of adhesives can be used in this layer so long as their properties and characteristics are consistent with the packaging requirements of the resulting assembly. The adhesive could be a hot melt pressure sensitive adhesive, such as for example a rubber-based or acrylic-based pressure sensitive adhesive. The adhesive could be a UV cured hot melt. The adhesive could be based on a rubber-based hot melt composition, a solvent rubber adhesive, a solvent acrylic adhesive, or a solvent polyurethane adhesive. The adhesive could be emulsion-based such as an emulsion acrylic adhesive. As noted, a wide array of adhesives could be used. Each of the aforementioned adhesives are preferably in the form of PSA's. An extensive selection of various pressure sensitive adhesives are disclosed in U.S. Pat. Nos. 5,623,011; 5,830,571; and 6,147,165; owned by the assignee of the present application, and incorporated herein by reference.

A preferred pressure sensitive adhesive for use in the pressure sensitive adhesive layer is commercially available under the designation Fasson® S692N. The S692N adhesive is an acrylic emulsion based adhesive. Generally, this adhesive is a polymeric blend of butyl acrylate and 2-ethyl-hexyl acrylate monomers with various tackifiers and processing acids. Other preferred pressure sensitive adhesives include, but are not limited to, emulsion acrylic adhesives and rubber-based hot melt adhesives.

The thickness of the pressure sensitive adhesive layer typically ranges from about 3 to about 40 microns and preferably from about 12 to about 20 microns. It will be understood however that the present invention includes cover laminates using thicknesses greater than or lesser than these thicknesses for the pressure sensitive adhesive layer.

Cover Release Layer

In accordance with another embodiment of the invention, the multilayer cover laminate includes a release layer. Preferably, the release layer is disposed immediately adjacent to the pressure sensitive adhesive layer in the cover laminate. Most preferably, the release layer is disposed between the pressure sensitive adhesive layer and the inner support layer. The release layer provides a release surface which, as previously noted, is immediately adjacent to, and in contact with, the pressure sensitive adhesive layer.

A wide variety of release materials such as those typically used for pressure sensitive tapes and labels are known, including silicones, alkyds, stearyl derivatives of vinyl polymers (such as polyvinyl stearyl carbamate), stearate chromic chloride, stearamides and the like. Fluorocarbon polymer coated release liners are also known but are relatively expensive. For most pressure sensitive adhesive applications, silicones are by far the most frequently used materials. Silicone release coatings have easy release at both high and low peel rates, making them suitable for a variety of production methods and applications.

Known silicone release coating systems consist of a reactive silicone polymer, e.g., an organopolysiloxane (often referred to as a "polysiloxane," or simply, "siloxane"); a cross-linker; and a catalyst. After being applied to the adjacent layer or other substrate, the coating generally must be cured to cross-link the silicone polymer chains, either thermally or radiatively (by, e.g., ultraviolet or electron beam irradiation).

Based on the manner in which they are applied, three basic types of silicone release coatings used in the pressure sensitive adhesive industry are known: solventborne, waterborne emulsions, and solvent free coatings. Each type has advantages and disadvantages. Solventborne silicone release coatings have been used extensively but, because they employ a hydrocarbon solvent, their use in recent years has tapered off due to increasingly strict air pollution regulations, high energy requirements, and high cost. Indeed, the energy requirements of solvent recovery or incineration generally exceed that of the coating operation itself.

Waterborne silicone emulsion release systems are as well known as solvent systems, and have been used on a variety of pressure sensitive products, including tapes, floor tiles, and vinyl wall coverings. Their use has been limited, however, by problems associated with applying them to paper substrates. Water swells paper fibers, destroying the dimensional stability of the release liner backing and causing sheet curling and subsequent processing difficulties.

Solventless silicone release coatings have grown in recent years and now represent a major segment of the silicone release coating market. Like other silicone coatings, they must be cured after being applied to the flexible liner substrate. Curing produces a cross-linked film that resists penetration by the pressure sensitive adhesive.

Informative descriptions of various release materials, their characteristics, and incorporation in laminate assemblies are provided in U.S. Pat. Nos. 5,728,469; 6,486,267; and US Published Patent Application 2005/0074549, owned by the assignee of the present application. It is also contemplated that various waxes known in the art could be used for the release material or utilized in the release layer.

The preferred cover laminates utilize release layers that are relatively thin. For example, a typical release layer thickness is from about 1 to about 4 microns. Preferably, the thickness of the release layer is from about 1 to about 2 microns.

Cover Inner Support

The preferred multilayer cover laminate includes an inner support or film layer. The inner support provides support for the cover laminate and particularly for the layers disposed adjacent to the inner support. Representative materials for the inner support include those noted herein for the outer support. In addition, it may be preferred to utilize a biaxially-oriented polypropylene (BOPP) material. These materials provide cost savings as they are relatively inexpensive, and they have sufficient stiffness to dispense well. Another preferred material for use in the inner support layer is polyethylene terephthalate (PET). The previously noted PVC and OPA polymeric materials may also be suitable for use in this layer.

The inner support thickness typically ranges from about 12 to about 60 microns, and preferably from about 12 to about 25 microns. The present invention includes the use of thicknesses greater than or lesser than these thicknesses.

Optionally, the inner support can incorporate a slip agent therein or thereon. The slip agent, when incorporated as a separate coating, can be very thin, preferably around 1 micron in thickness and can comprise, for example, silicon based slip agents.

Cover Heat Sealing Layer

The preferred multilayer cover laminate includes a heat sealing layer. Preferably, the heat sealing layer is disposed along the underside or inner face of the cover laminate that contacts a corresponding face of the container upon thermal bonding of the cover to the container.

The heat sealing layer is a layer which is activated by heat to allow the layer to bond to a plastic substrate. Materials for the heat sealing layer include, but are not limited to, the following film-forming materials used alone or in combination such as polyethyelene, metallocene catalyzed polyolefins, syndiotactic polystyrene, syndiotactic polypropylene, cyclic polyolefins, polyethylene methyl acrylic acid, polyethylene ethyl acrylate, polyethylene methyl acrylate, acrylonitrile butadiene styrene polymer, polyethylene vinyl alcohol, polyethylene vinyl acetate, nylon, polybutylene, polystyrene, polyurethane, polysulfone, polyvinylidene chloride, polypropylene, polycarbonate, polymethyl pentene, styrene maleic anhydride polymer, styrene acrylonitrile polymer, ionomers based on sodium or zinc salts of ethylene/methacrylic acid, polymethyl methacrylates, cellulosics, fluoroplastics, polyacrylonitriles, and thermoplastic polyesters. Preferably, PE is used in the heat sealing layer, more preferably, a blend of PE and EVA, such as for example, a blend of PE and EVA with special antiblock and antistatic additives. Another preferred material for use in the heat sealing layer is glycol-modified polyethylene terephthalate (PETG). A most preferred material for the heat sealing layer is linear low density polyethylene (LLDPE).

The thickness of the heat sealing layer may vary according to requirements of the packaging assembly. Typical thicknesses of this layer are from about 15 to about 90 microns and preferably from about 30 to about 60 microns.

The heat sealing layer is designed to be activated at temperatures known to those skilled in the art. While the heat sealing layer may activate at temperatures below those specified for activation, the heat sealing layer is designed to activate at certain temperatures based on the substrate material. Preferably, the heat sealing layer activates at temperatures between about 90° C. to about 150° C., more preferably the heat sealing layer activates at temperatures between about 110° C. to about 140° C., and most preferably the heat sealing layer activates at temperatures between about 120° C. to about 130° C. Preferably, pressure is also applied to the respective surfaces during heat sealing.

Cover Printing Layer

An optional printing layer may be disposed on the previously described cover outer support. The printing layer serves to receive and retain one or more inks deposited on the printing layer. The ink(s) constitute indicia or other markings for the cover laminate and package assembly. The printing layer can be formed from a wide range of materials typically known to those skilled in the art. For example, a variety of polyvinyl alcohol (PVA) and cellulose-based materials can be used for the printing layer.

The printing layer typically ranges from about 3 to about 20 microns in thickness and preferably, from about 3 to about 8 microns in thickness.

The various containers and methods described herein find wide application and use. For example, the containers can be used for packaging food products, medical goods and related products, and an assortment of personal care and/or cosmetic products. Representative examples of food products include but are not limited to lunch meats, cheese products, vegetable goods, and other prepared foods. Representative examples of medical goods include but are not limited to sterilized pads, wound aid agents or the like; contact lenses; pills and other pharmaceutical agents and the like. It is also contemplated that the containers can be used for packaging electronic components, machined parts, and industrial parts.

The various tamper indication provisions described herein can be utilized in a wide array of packaging and container systems, for example the containers disclosed in PCT application US2010/29352 filed Mar. 31, 2010.

Many other benefits will no doubt become apparent from future application and development of this technology.

All patents, published applications, and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A resealable, tamper evident container comprising:

a substrate defining an outer face and an oppositely directed inner face;

a cover layer disposed on the substrate, the cover layer defining an outer face and an oppositely directed inner face, the cover layer and the substrate being sealed to one another in at least one sealing region to thereby define an initially sealed interior hollow region for storage, the cover layer and the substrate defining a peripheral edge extending about at least a portion of an outer perimeter of the container, the cover layer defining two lines of weakened material extending between a first region of the edge to a second region of the edge and proximate the interior hollow region, wherein the two lines of weakened material define a tear off tab extending between the two lines of weakened material and the first and second regions of the peripheral edge, the at least one sealing region extending between the tear off tab and the interior hollow region, the cover layer and the substrate further defining a sealing-free region co-extensive with the two lines of weakened material, wherein the cover layer includes a release layer;

wherein a releasable yet resealable adhesive is disposed within the at least one sealing region, wherein the tear off tab defines a pull end adjacent to one of the first and second regions of the peripheral edge and proximate the sealing-free region, wherein the cover layer defines a peel tab and the sealing-free region is co-extensive with the peel tab, wherein both the tear off tab and the peel tab constitute a portion of the cover layer and both the tear off tab and the peel tab are free of sealing to the substrate, and wherein the two lines of weakened material comprise perforations extending through an entire thickness of the cover layer.

2. The tamper evident container of claim 1 wherein the two lines of weakened material consist of the perforations.

3. The tamper evident container of claim 1 wherein the two lines of weakened material further comprise scores.

4. The tamper evident container of claim 1 wherein the cover layer is a multilayer laminate.

5. The tamper evident container of claim 1 wherein the interior hollow region is defined between the inner face of the cover layer, the inner face of the substrate, and within the at least one sealing region.

6. The tamper evident container of claim 1 wherein the inner face of the substrate underlying the tear off tab has a different color than the tear off tab.

7. The tamper evident container of claim 1 wherein the cover layer includes an overhanging material section proximate to the pull end of the tear off tab.

8. A resealable, tamper evident container comprising:

a substrate;

a cover layer sealingly joined to the substrate, the substrate and the cover layer defining an interior hollow region for storage therebetween, the cover layer including two lines of weakened material defining a tear off tab, the cover layer also defining a peel tab adjacent to the tear off tab, wherein both the tear off tab and the peel tab constitute portion of the cover layer and both the tear off tab and the peel tab are free of sealing to the substrate, and the peel tab can only be accessed after separation of at least a portion of the tear off tab from the substrate, the separation providing evidence of container tampering, wherein the cover layer includes a release layer and the container includes at least one sealing region extending around the interior hollow region and a releasable yet resealable adhesive is disposed within the at least one sealing region, and wherein the two lines of weakened material comprise perforations extending through an entire thickness of the cover layer.

9. The tamper evident container of claim 8 wherein the tear off tab and the peel tab are free of any sealing region.

10. The tamper evident container of claim 8 wherein the two lines of weakened material consist of the perforations.

11. The tamper evident container of claim 8 wherein the two lines of weakened material further comprise scores.

12. The tamper evident container of claim 8 wherein the cover layer is a multilayer laminate.

13. The tamper evident container of claim 8 wherein the container defines a peripheral edge and the tear off tab extends between a first region of the peripheral edge and a second region of the peripheral edge.

14. The tamper evident container of claim 8 wherein the substrate defines an inner face which exhibits a different color than the tear off tab.

15. The tamper evident container of claim 8 wherein the cover layer includes an overhanging material section proximate an end of the tear off tab.

16. A method of providing indication of container opening attempts having occurred, the method comprising:

providing the container of claim 1; and separating at least a portion of the tear off tab from the substrate whereby at least a portion of the line of weakened material is severed, thereby providing indication of occurrence of an attempt to open the container.

17. The method of claim 16 wherein the substrate includes a colored region proximate the tear off tab which is visible upon separating the tear off tab from the substrate.

18. The method of claim 16 wherein the lines of weakened material include a scored region in the cover layer.

19. The method of claim 16 wherein the cover layer is a multilayer laminate.

20. The method of claim 16 wherein the cover layer includes an overhanging material section proximate to an end of the tear off tab.

* * * * *